US006656421B2

(12) United States Patent
Ochiai et al.

(10) Patent No.: US 6,656,421 B2
(45) Date of Patent: Dec. 2, 2003

(54) ALUMINUM-BERYLLIUM-SILICON BASED ALLOY

(75) Inventors: Toshimasa Ochiai, Nagoya (JP); Hiroshi Yamada, Wako (JP); Masami Hoshi, Wako (JP)

(73) Assignees: NGK Insulators, Ltd., Nagoya (JP); Honda Giken Kogyo Kabushiki Kaisha, Minato-ku (JP)

( * ) Notice: Subject to any disclaimer, the term of this patent is extended or adjusted under 35 U.S.C. 154(b) by 0 days.

(21) Appl. No.: 09/974,752

(22) Filed: Oct. 10, 2001

(65) Prior Publication Data

US 2002/0106300 A1 Aug. 8, 2002

(30) Foreign Application Priority Data

Oct. 11, 2000 (JP) ..... 2000-310108

(51) Int. Cl.[7] ..... C22C 21/00

(52) U.S. Cl. ..... 420/534; 420/535; 420/538; 420/546; 420/547

(58) Field of Search ..... 420/534, 535, 420/544, 546, 547, 548, 538

(56) References Cited

U.S. PATENT DOCUMENTS

| | | | | |
|---|---|---|---|---|
| 2,286,627 A | * | 6/1942 | Kempf et al. | 420/546 |
| 3,664,889 A | | 5/1972 | McCarthy et al. | |

FOREIGN PATENT DOCUMENTS

| | | |
|---|---|---|
| EP | 0921203 A1 | 6/1999 |
| JP | 53-30654 | 8/1978 |
| JP | 61-259829 | 11/1986 |
| JP | 9-501740 | 2/1997 |
| JP | 11-172360 | 6/1999 |
| WO | WO 95/27089 | 10/1995 |

* cited by examiner

*Primary Examiner*—George Wyszomierski
*Assistant Examiner*—Janelle Combs Morillo
(74) *Attorney, Agent, or Firm*—Burr & Brown

(57) ABSTRACT

An aluminum-beryllium-silicon based alloy is disclosed, which comprises 5.0 to 30.0 mass % of Be, 0.1 to 15.0 mass % of Si and 0.1 to 3.0 mass %, the balance being Al and inevitable impurities. The alloy is useful for producing automobile engine parts, etc.

7 Claims, 1 Drawing Sheet

ALUMINUM-BERYLLIUM-SILICON BASED ALLOY

BACKGROUND OF THE INVENTION (1) Field of the Invention

The present invention relates to an aluminum-beryllium-silicon based alloy to be favorably used for producing automobile engine parts, etc.

(2) Related Art Statement

Automobile engines, particularly high-performance engines, are required to operate at high rpms to generate high outputs, and therefore lighter high-strength materials, that is, materials having higher specific strengths, are demanded for this requirement.

Further, weight reduction is also important for enhancing drivability. In order to prevent drop in rigidity even if thinned or lighter materials are used, lighter materials having higher Young's modulus, that is, materials having higher specific moduli of rigidity are required.

Furthermore, from the standpoint that outputs are ensured by keeping a clearance constant against changes in temperature, materials having smaller coefficients of thermal expansion and excellent wear resistance and heat resistance are demanded.

In addition, as viewed from the manufacturing methods, moving parts of the high-performance engines are made mainly of forged products which can fully exhibit the potentials of the alloys thereof, so that materials having excellent plastic workability are desired. Casings and the like having thin and complicated shapes can be produced by casting only. Therefore, castable alloys are naturally desired.

Under the above circumstances, Al—Si based aluminum alloys have been generally used for engine parts. In order to increase the specific strength of such alloys, primary Si crystals are made finer by quenching or a highly heat-resistive hard ingredient is incorporated.

For example, materials having strength and toughness enhanced by quenching in powder metallurgy are reported in "Light metals, Vol. 49, No. 4, 1999, pp 178–182, and composite materials (MMC) in which ceramic particles or intermetallic compound particles are dispersed in an Al matrix are reported in "Light metals, Vol. 49, No. 9, 1999, pp 438–442.

However, since these materials have low ductility, it is difficult to shape them by conventional forging methods, and it is also difficult to use them for producing cast products.

Further, since their specific gravities are equivalent to or greater than that of Al, their specific strength does not rise, so that there remains a problem that it is difficult to realize high rpms to generate high outputs.

On the other hand, Al alloys in which an appropriate amount of Be is incorporated into Al have been known as materials having high specific moduli of rigidity for a long time. As examples of such alloys, Al alloys are proposed in U.S. Pat. Nos. 2,399,104, 5,578,146, etc.

However, since all of such alloys are produced by using the powdery metallurgy as a producing method, it is extremely difficult to plastically work the alloys into complicated shapes by forging.

On the other hand, for example, U.S. Pat. Nos. 5,417,778, 5,667,600, etc. disclose Al alloys which employ the casting method.

However, the Al alloys obtained by this method have tensile strengths of about 170 to about 320 MPa and low elongations of around 2%. However, if the alloy is extruded to cover these defects, primary crystals of Be are elongated to unfavorably increase anisotropy.

Al alloys into which Be is incorporated at high concentrations are likely to be expensive, so that such alloys can be used for limited purposes only.

SUMMARY OF THE INVENTION

The present invention has been developed in view of the above-mentioned circumstances, and is aimed at providing aluminum-beryllium-silicon based alloys which are not only light, of high specific modulus of rigidity and of high specific strength, but also have small coefficients of thermal expansion and excellent wear resistance and heat resistance with castability and plastic workability comparable to those of the conventional Al alloys.

The breakthrough history of the present invention will be explained below.

In order to realize the above objects, the present invention made investigations on elements effective to enhance wear resistance and reduce the coefficient of thermal expansion with respect to Al as a base material. As a result, they discovered that Si is useful as such elements, and discovered that if Si is incorporated in an amount of not less than 0.1 mass % (preferably and less than 5 mass %), excellent wear resistance and advantageously reduced coefficient of thermal expansion can be attained.

Next, the present invention made investigations upon elements to reduce the specific gravity and increase the specific modulus of rigidity with respect to the above Al—Si alloys, and came to know that Be is effective.

However, it was also discovered that the addition of Be increases the specific modulus of rigidity but unfavorably decrease strength at high temperatures.

In view of this, the inventors then repeatedly made strenuous investigations to prevent reduction in the strength of high temperatures due to the decreased specific gravity. As a result, the present inventors came to know that the addition of Mg is extremely effective for realizing this purpose.

It was also discovered that Cu, Ni, Co, Fe and a very small amount of Y or Ti are effective as ingredients for enhancing strength at high temperatures.

Particularly, it was further discovered that the addition of Fe makes crystals of Be granular, which facilitates working such as extrusion.

The present invention was accomplished based on the above knowledge.

(1) The present invention relates to an aluminum-beryllium-silicon based alloy comprising 5.0 to 30.0 mass % of Be, 0.1 to 15.0 mass % of Si and 0.1 to 3.0 mass % of Mg, the balance being Al and inevitable impurities.

As the aluminum-beryllium-silicon alloy (1), the following are preferable.

(2) The aluminum-beryllium-silicon based alloy further comprises at least one of 0.1 to 3.0 mass % of Cu, 0.05 to 1.5 mass % of Ni, 0.05 to 1.5 mass % of Co and 0.05 to 1.5 mass % of Fe.

The aluminum-beryllium-silicon based alloy (1) or (2) further comprises 0.01 to 0.8 mass % of Y and 0.01 to 0.1 mass % of Ti.

BRIEF DESCRIPTION OF THE DRAWINGS

For a better understanding of the invention, reference is made to the attached drawings, wherein.

DETAILED DESCRIPTION OF THE INVENTION

Figure 1:
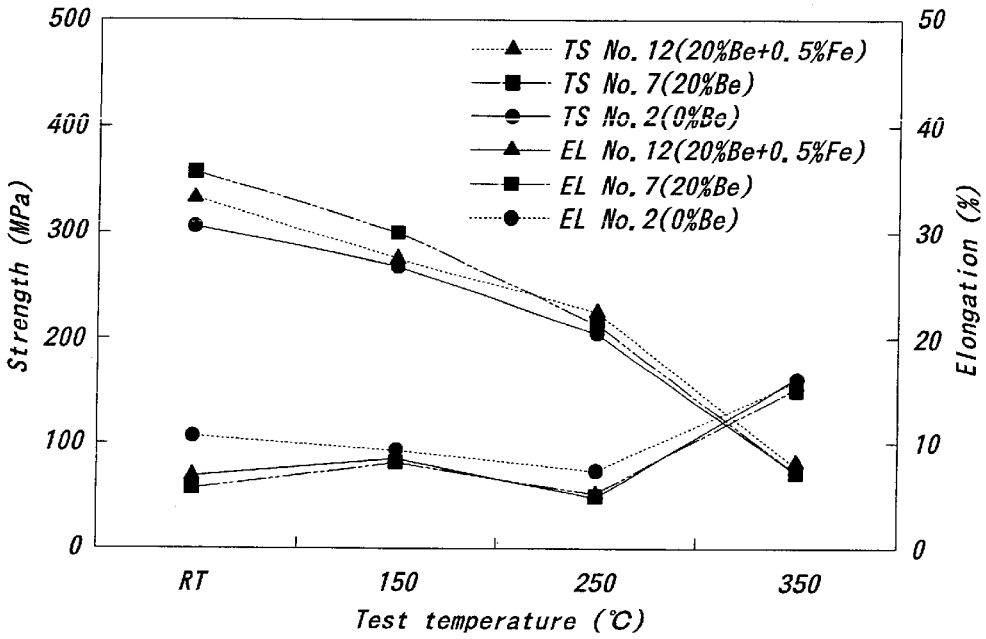
FIG. 1 is a graph showing the influence of the content of Be upon the strength and the elongation at high temperatures.

The reasons why the composition of the Al-based alloy according to the present invention is limited as mentioned above will be explained below.

Be: 5.0 to 30.0 mass %

Be is an element useful for increasing the strength, reducing the specific gravity and increase the specific modulus of rigidity. However, if the content is less than 5 mass %, it has no effect to decrease the specific gravity, whereas if it is more than 30 mass %, extrusion workability and plastic workability such as forging workability are not only deteriorated, but also the primary crystals of Be are elongated to cause the anisotropy. Therefore, the content of Be is limited to the range of 5.0 to 30.0 mass %.

Si: 0.1 to 15.0 mass %

Si is an element useful to reduce the coefficient of thermal expansion and enhance the forgoing workability, wear resistance and strength. If the content is less than 0.1 mass %, the effect due to the addition is scarce, whereas if it is more than 15 mass %, the elongation is extremely lowered and the plastic workability is deteriorated. Therefore, Si is limited to the range of 0.1 to 15.0 mass %, preferably 5.0 to 15.0 mass %.

If the content of Si is relative small (Si being less than 5.0 mass %), the content of Be is preferably not less than 20.0 mass %.

Mg: 0.1 to 3.0 mass %

Mg is an element useful for effectively enhancing the high temperature strength by aging hardening. If the content is less than 0.1 mass %, an effect upon the aging hardening is small, whereas if it is more than 3 mass %, Mg form compounds with Be and Si. Therefore, Mg is limited to the range of 0.1 to 3.0 mass %.

If the content of Si is relatively small (Si being less than 5.0 mass %), Mg is preferably not less than 1 mass %.

In the above, the essential ingredients are explained. In the present invention, the following elements may be appropriately incorporated.

Cu: 0.1 to 3.0 mass %

Cu effectively contributes to increase in strength at high temperatures. However, if it is less than 0.1 mass %, Cu does not contributes to increase in strength, whereas if it is more than 3.0 mass %, forging workability is deteriorated. Thus, Cu is limited to a range of 0.1 to 3.0 mass %.

Ni: 0.05 to 1.5 mass %, Co: 0.05 to 1.5 mass %, Fe: 0.05 to 1.5 mass %

Ni, Co and Fe are all elements to effectively contribute to increase in strength at high temperatures as in the case with Cu. However, if the content of each of them is less than 0.05 mass %, no effect to increase the high-temperature strength is obtained, whereas if it is more than 1.5 mass %, the specific gravity becomes large. Thus, each of these elements is limited to a range of 0.05 to 1.5 wt %. Fe also has an effect to make the primary crystals of Be spherical.

If the above Si content is relatively small (Si<5.0 mass %), it is preferable that no less than 1.5 mass % of Cu and/or not less than 0.5 mass % of each of Ni, Co and Fe are contained.

Y: 0.01 to 0.8 mass %. Ti: 0.01 to 0.1 mass %

Both Y and Ti are elements effective to increase strength at high temperatures. However, if the content of each of them is less than 0.01 mass %, an effect due to the addition is poor, whereas if Y exceeds more than 0.8 mass % or if Ti exceeds 0.1 mass %, the effect is saturated. Thus, Y may be contained in a range of 0.01 to 0.8 mass %, whereas Ti may be contained in a range of 0.01 to 0.1 mass %.

Next, the method for producing the alloy according to the present invention will be explained below.

The present invention is not limited to any particular producing method, but may employ any conventionally known producing condition.

That is, after an ingot is formed into a desired shape, the shaped product is subjected to a solid solution treatment at 500 to 545° C., which then if necessary may be aging hardened at 150 to 250° C.

EXAMPLES

Example 1

A variety of Al-based alloys having compositions shown in Table 1 were melted and cast in air or in vacuum, and columnar materials were cut out from the respective ingots. The columnar materials were isostatically extruded at a temperature of 500° C., while extrusion rates were variously changed. Thereafter, after a sample material was cut out and subjected to solid solution treatment-aging hardening treatment (T6 treatment), a tensile test was effected in a range of room temperature to a high temperature of 350° C. with use of a JIS 5 test piece. The T6 treatment was effected under the condition that the solid solution treatment was at 515° C. for 10 hours and the aging hardening at 160° C. for 6 hours.

With respect to Al—Be binary element-based alloys (Alloys R to T) as conventional materials, they were subjected to the tensile test at the high temperature without effecting the T6 treatment. The reason is that the so-called Al—Be alloys containing relatively much Be have relatively reduced rates of the Al matrix, so that increase in strength through the T5 treatment cannot be expected.

Various mechanical properties of the thus obtained products (cast-extruded products) were examined, and results are shown in Table 2.

Physical properties of products were determined as follows.

(1) Tensile Strength

Tensile strength of a test piece No. 14A of JIS Z2201 was obtained by dividing a breaking load by a sectional area of the test piece according to JIS Z2241.

(2) Elongation

Elongation was obtained by (L-Lo)/Lo in which Lo was an initial distance between initial scale lines and L was a distance between those scale lines at break according to Z2241.

(3) Specific Gravity

Specific gravity was determined by Archimedean method.

(4) Specific Strength

Specific strength was obtained by dividing the tensile strength by the specific gravity. The specific gravity at room temperature was used even at a high temperature.

(5) Young's Modulus

Young's modulus was a gradient of stress amount to strained amount in the test piece.

(6) Specific Rigidity

Specific rigidity was obtained by dividing Young's modulus by the specific gravity.

Figure 2:
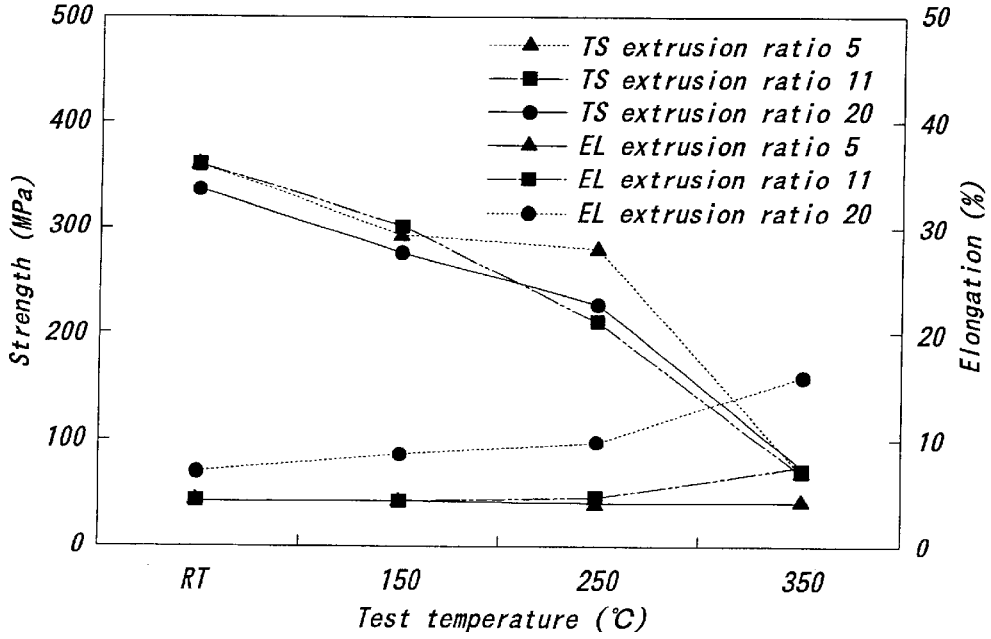
FIG. 2 is a graph showing the influence of the extrusion rate upon the strength and the elongation at high temperatures

FIG. 1 shows changes in the high-temperature characteristic when the content of Be was varied, and FIG. 2 shows changes in the high-temperature characteristic when the extrusion rate was varied.

TABLE 1

| | Composition (mass %) | | | | | | | | | | |
|---|---|---|---|---|---|---|---|---|---|---|---|
| Alloy | Be | Si | Mg | Cu | Ni | Co | Fe | Y | Ti | bal. Al | Remarks |
| A | — | 6.2 | 0.4 | — | — | — | — | — | — | " | Conventional Example |
| B | — | 10.5 | 0.9 | — | 0.7 | — | — | — | — | " | Conventional Example |
| C | 4.6 | 5.9 | 0.4 | | — | — | — | — | — | " | Comparative Example |
| D | 8.1 | 6.0 | 0.4 | — | | | | | | " | Invention Example |
| E | 13.4 | 5.6 | 0.5 | — | — | — | — | — | — | " | Invention Example |
| F | 14.7 | 9.2 | 1.4 | — | 0.7 | — | — | — | — | " | Invention Example |
| G | 19.8 | 8.8 | 1.6 | 0.8 | 0.7 | — | — | — | — | " | Invention Example |
| H | 20.4 | 15.3 | 1.4 | 0.8 | 0.8 | — | — | — | — | " | Comparative Example |
| I | 19.7 | 8.6 | 1.1 | 0.8 | 0.7 | 1.0 | — | — | — | " | Invention Example |
| J | 20.2 | 8.8 | 1.4 | 0.8 | 0.8 | 1.0 | — | — | — | " | Invention Example |
| K | 19.2 | 8.6 | 2.3 | 2.1 | 0.7 | 1.0 | — | — | — | " | Invention Example |
| L | 20.1 | 8.7 | 1.7 | 0.8 | 0.7 | — | 0.5 | — | — | " | Invention Example |
| M | 24.1 | 8.9 | 1.3 | — | — | — | — | 0.4 | — | " | Invention Example |
| N | 20.2 | 0.14 | 1.8 | — | — | — | — | — | — | " | Invention Example |
| O | 19.5 | 0.35 | 1.0 | 0.8 | 0.7 | 1.0 | 1.02 | — | — | " | Invention Example |
| P | 21.9 | 0.17 | 1.52 | 1.95 | 0.93 | 1.04 | 1.06 | 0.09 | 0.27 | " | Invention Example |
| Q | 20.0 | 0.14 | 1.66 | 1.85 | 1.45 | — | 0.99 | — | 0.06 | " | Invention Example |
| R | 30.0 | — | — | — | — | — | — | — | — | " | Conventional Example |
| S | 40.0 | — | — | — | — | — | — | — | — | " | Conventional Example |
| T | 65.0 | — | — | — | — | — | — | — | — | " | Conventional Example |

TABLE 2

| No. | Alloy | Extrusion rate | Re-fining | Specific gravity | Young's modulus (GPa) | Tensile strength (MPa) | Elongation % | Tensile strength (25° C.) (MPa) | Specific gravity (MPa) | Specific rigidity (GPa) | Tensile strength (250° C.) (MPa) | Remarks |
|---|---|---|---|---|---|---|---|---|---|---|---|---|
| 1 | A | 20 | 76 | 2.67 | 74.4 | 248 | 23.0 | 195 | 92.9 | 27.9 | 73.0 | Conventional Example |
| 2 | B | 20 | 76 | 2.68 | 81.0 | 311 | 10.9 | 209 | 116.0 | 30.2 | 78.0 | Conventional Example |
| 3 | C | 20 | 76 | 2.59 | 71.0 | 259 | 18.0 | 186 | 100.0 | 27.4 | 71.8 | Comparative Example |
| 4 | D | 20 | 76 | 2.55 | 79.1 | 273 | 14.0 | 192 | 107.1 | 31.0 | 75.3 | Invention Example |
| 5 | E | 20 | 76 | 2.49 | 92.7 | 295 | 17.0 | 220 | 118.5 | 37.2 | 88.4 | Invention Example |
| 6 | F | 20 | 76 | 2.47 | 92.0 | 330 | 7.7 | 185 | 133.6 | 37.2 | 74.9 | Invention Example |
| 7 | G | 20 | 76 | 2.42 | 99.0 | 361 | 5.8 | 214 | 149.2 | 40.9 | 88.4 | Invention Example |
| 8 | H | 20 | 76 | 2.45 | 100.0 | 303 | 0.9 | 193 | 123.7 | 40.8 | 78.8 | Comparative Example |
| 9 | I | 20 | 76 | 2.49 | 97.0 | 296 | 5.6 | 183 | 118.9 | 39.0 | 73.5 | Invention Example |
| 10 | J | 20 | 76 | 2.49 | 100.0 | 331 | 4.8 | 212 | 132.9 | 40.2 | 85.1 | Invention Example |
| 11 | K | 20 | 76 | 2.49 | 100.0 | 345 | 4.0 | 217 | 138.5 | 40.2 | 87.1 | Invention Example |

TABLE 2-continued

| No. | Alloy | Extrusion rate | Re-fining | Specific gravity | Young's modulus (GPa) | Tensile strength (MPa) | Elongation % | Tensile strength (25° C.) (MPa) | Specific gravity (MPa) | Specific rigidity (GPa) | Tensile strength (250° C.) (MPa) | Remarks |
|---|---|---|---|---|---|---|---|---|---|---|---|---|
| 12 | L | 20 | 76 | 2.47 | 97.0 | 337 | 7.4 | 230 | 136.4 | 39.3 | 93.1 | Invention Example |
| 13 | " | 11 | 76 | 2.47 | 100.0 | 362 | 4.6 | 284 | 146.5 | 40.5 | 115.0 | Invention Example |
| 14 | " | 5 | 76 | 2.47 | 100.0 | 363 | 4.5 | 215 | 147.0 | 40.5 | 87.0 | Invention Example |
| 15 | M | 20 | 76 | 2.46 | 107.0 | 336 | 4.8 | 224 | 136.6 | 43.5 | 91.1 | Invention Example |
| 16 | N | 20 | 76 | 2.44 | 98.5 | 322 | 4.5 | 198 | 132.0 | 40.4 | 81.1 | Invention Example |
| 17 | O | 20 | 76 | 2.49 | 99.0 | 335 | 4.2 | 203 | 134.5 | 39.8 | 81.5 | Invention Example |
| 18 | P | 20 | 76 | 2.55 | 98.1 | 372 | 6.9 | 218 | 145.9 | 38.5 | 85.5 | Invention Example |
| 19 | Q | 20 | 76 | 2.51 | 99.3 | 375 | 5.6 | 225 | 149.4 | 39.6 | 89.6 | Invention Example |
| 20 | R | 20 | — | 2.40 | 115.0 | 243 | 9.6 | — | 101.3 | 48.3 | — | Conventional Example |
| 21 | S | 17 | — | 2.35 | 135.0 | 250 | 7.5 | — | 106.4 | 57.4 | — | Conventional Example |
| 22 | T | 11 | — | 2.09 | 196.0 | 315 | 11.0 | 177 | 150.7 | 93.8 | 84.7 | Conventional Example |
| 23 | " | 4 | — | 2.09 | 196.0 | 245 | 5.7 | 150 | 117.2 | 93.8 | 71.8 | Conventional Example |

As shown in Table 2, it is seen that all the Al—Be—Si based alloys satisfying the composition range according to the present invention not only have excellent plastic workability and strength as comparable to those of the conventional Al—Si based alloys, but also possess the specific strengths comparable to those of the conventional Al—Be based alloys.

Particularly, test pieces using Alloy L shown by Nos. 12 to 14 in which 0.5 mass % of Fe was incorporated afforded not only excellent tensile strengths of 337 to 363, but also good specific moduli of rigidity of around 40 GPa and specific strengths of 136 to 147 MPa at room temperature and 87 to 115 MPa at 250° C.

To the contrary, only low specific gravities were obtained with respect to the conventional Al—Si based alloys containing no Be (Alloys A, B) containing no Be and Comparative Example No. 3 (Alloy C) containing Be in amount less than the lower limit.

Further, since Comparative Example No. 8 (Alloy H) had the Si content exceeding the upper limit in the present invention, elongation greatly lowered.

When the conventional Al—Be alloys containing relatively large amounts of 30 to 40 mass % Be (Alloys R, S) were worked at high extrusion rates of 17 to 20, the strength, particularly the strength at the high temperature were obliged to be conspicuously reduced. In this respect, when the extrusion rates were as low as 4 to 11 (Nos. 22, 23), no such conspicuous reduction occurred, whereas the tensile strength at the high temperature largely decreased. The usual conventional Al—Be alloys contains as much as around 65 mass % Be.

Example 2

Each of Al-based alloys having various compositions shown in Table 3 was melted in air and poured into a mold with simultaneous application of pressure, thereby producing an ingot. A sample piece cut out from the ingot was subjected to the same T6 treatment as in Example 1 and then to the tensile test.

The mechanical properties of the thus obtained products (cast products) were examined, and results are shown in Table 4.

TABLE 3

| Alloy | Composition Be | Si | Mg | Ti | bal. Al | Remarks |
|---|---|---|---|---|---|---|
| U | — | 6.2 | 0.4 | — | " | Conventional Example |
| V | 4.6 | 5.9 | 0.4 | — | " | Comparative Example |
| W | 8.1 | 6.0 | 0.4 | — | " | Invention Example |
| X | 13.4 | 5.6 | 0.5 | — | " | Invention Example |
| Y | 13.4 | 5.5 | 1.1 | 0.1 | " | Invention Example |
| Z | 17.9 | 5.2 | 0.4 | 0.1 | " | Invention Example |

TABLE 4

| No. | Alloy | Refining | Specific gravity | Young's modulus (GPa) | Tensile strength (MPa) | Elongation % | Tensile strength (250° C.) (MPa) | Specific gravity (MPa) | Specific rigidity (GPa) | Tensile strength (250° C.) (MPa) | Remarks |
|---|---|---|---|---|---|---|---|---|---|---|---|
| 24 | U | — | 2.67 | 70.0 | 191 | 11.0 | — | 71.5 | 26.2 | — | Conventional Example |
| 25 | V | — | 2.59 | 72.4 | 180 | 13.5 | — | 69.5 | 28.0 | — | Comparative Example |
| 26 | W | — | 2.55 | 85.0 | 162 | 10.5 | — | 63.5 | 33.3 | — | Invention Example |
| 27 | X | — | 2.49 | 77.5 | 198 | 8.0 | — | 79.5 | 31.1 | — | Invention Example |
| 28 | Y | 76 | 2.49 | 90.0 | 246 | 7.1 | 165 | 98.8 | 36.1 | 66.3 | Invention Example |
| 29 | Z | 76 | 2.48 | 98.0 | 246 | 4.8 | 162 | 99.2 | 39.5 | 65.3 | Invention Example |

As shown in Table 4, even the cast products in Invention Examples obtained according to the present invention all afforded excellent mechanical properties.

With respect to a part of the samples, the coefficient of thermal expansion and the thermal conductivity were measured. As seen from results shown in Table 5, the coefficients of thermal expansion of the Al—Be—Si based alloys obtained according to the present invention largely decreased as compared with the conventional alloy.

TABLE 5

| Alloy | Thermal conductivity (W/m-k) | Coefficient of thermal expansion ($\times 10^{-6}$/° C.) | Remarks |
|---|---|---|---|
| A | 151 | 21.4 | Conventional Example |
| B | 141 | 19.5 | Conventional Example |
| L | 142 | 14.3 | Invention Example |

As having been described, the present invention can produce the aluminum-beryllium-silicon based alloys which are not only light, of high specific modulus of rigidity and of high specific strength, but also have small coefficients of thermal expansion and excellent wear resistance and heat resistance with castability and plastic workability comparable to the conventional Al alloys.

What is claimed is:

1. An aluminum-beryllium-silicon based alloy comprising 5.0 to 30.0 mass % of Be, 0.1 to 15.0 mass % of Si, 0.1 to 3.0 mass % of Mg, at least one element selected from the group consisting of 0.1 to 3.0 mass % of Cu, 0.05 to 1.5 mass % of Ni, 0.05 to 1.5 mass % of Co and 0.05 to 1.5 mass % of Fe, and the balance being Al and inevitable impurities.

2. The aluminum-beryllium-silicon based alloy set forth in claim 1, further comprising at least one element selected from the group consisting of 0.01 to 0.8 mass % of Y and 0.01 to 0.1 mass % of Ti.

3. The aluminum-beryllium-silicon based alloy set forth in claim 1, wherein Si is present in an amount of 5.0 to 15.0 mass %.

4. The aluminum-beryllium-silicon based alloy set forth in claim 1, wherein Si is present in an amount of less than 5.0 mass %, Be is present in an amount of not less than 20.0 mass %, and Mg is present in an amount of not less than 1 mass %.

5. The aluminum-beryllium-silicon based alloy set forth in claim 1, wherein Si is present in an amount of less than 5.0 in mass %, Cu is present in an amount of not less than 1.5 mass %, and each of Ni, Co and Fe is present in an amount of not less than 0.5 mass %.

6. An aluminum-beryllium-silicon based alloy comprising 5.0 to 30.0 mass % of Be, 0.1 to 15.0 mass % of Si, 0.1 to 3.0 mass % of Mg, at least one element selected from the group consisting of 0.01 to 0.8 mass % of Y and 0.1 to 0.1 mass % of Ti, and the balance being Al and inevitable impurities.

7. An aluminum-beryllium-silicon based alloy comprising 5.0 to 30.0 mass % of Be, 5.0 to 15.0 mass % of Si and 0.1 to 3.0 mass % of Mg, the balance being Al and inevitable impurities.

* * * * *

UNITED STATES PATENT AND TRADEMARK OFFICE

CERTIFICATE OF CORRECTION

PATENT NO. : 6,656,421 B2 
DATED : December 2, 2003
INVENTOR(S) : Toshimasa Ochiai, Hiroshi Yamada and Masami Hoshi It is certified that error appears in the above-identified patent and that said Letters Patent is hereby corrected as shown below:

Column 1,
Lines 15-16, please change "required. Further," to -- required. Further, --
Line 17, please add -- a -- after "prevent"
Line 19, please add -- a -- after "having"
Line 20, please change "rigidity" to -- rigidity, --
Lines 20-21, please change "required. Furthermore," to -- required. Furthermore, --
Lines 25-26, please change "demanded. In addition," to -- demanded. In addition, --
Line 27, please change "moving" to -- the moving --
Line 27, please delete "the"

Column 2,
Line 29, please change "invention" to -- inventors --
Lines 32-33, please change "effective. However," to -- effective. However, --

Column 3,
Line 6, please add -- . -- after "temperatures"
Line 14, please change "increase" to -- increasing --
Line 18, please add -- , -- after "workability" (both occurrences)
Line 19, please delete "also"
Line 19, please add -- also -- before "elongated"
Line 46, please add -- an -- before "increase"
Line 48, please change "contributes" to -- contribute --
Line 48, please add -- an -- before "increase"
Line 49, please add -- the -- before "forging"
Line 54, please add -- an -- before "increase"
Line 54, please change "temperatures" to -- temperatures, --
Line 56, please delete "effect to"
Line 56, please change "the" to -- in --
Lines 60-61, please change "spherical . If" to -- spherical. If --

Column 7,
Line 38, please change "comparable" to -- compared --
Lines 41-42, please change "alloys. Particularly," to -- alloys. Particularly --
Line 43, please add -- , -- after "14"
Line 43, please add -- , -- after "incorporated"
Line 50, please add -- , -- after "(Alloys A, B)"
Lines 52-53, please change "limit. Further," to -- limit. Further, --
Line 54, please change "the" (first occurrence) to -- an --
Line 55, please add -- was -- after "elongation"
Lines 55-56, please change "lowered. When" to -- lowered. When --

UNITED STATES PATENT AND TRADEMARK OFFICE

CERTIFICATE OF CORRECTION

PATENT NO. : 6,656,421 B2 
DATED : December 2, 2003
INVENTOR(S) : Toshimasa Ochiai, Hiroshi Yamada and Masami Hoshi It is certified that error appears in the above-identified patent and that said Letters Patent is hereby corrected as shown below:

Column 9,
Line 42, please change “of’ (first occurrence) to -- have --
Line 43, please delete “of” (first occurrence)
Line 43, please add -- which -- after “but”
Line 44, please change “expansion and excellent” to -- expansion, excellent --
Line 46, please delete “the”

Column 10,
Line 42, please change “0.1 to 0.1” to -- 0.01 to 0.1 --

Signed and Sealed this

Twenty-third Day of March, 2004

JON W. DUDAS
*Acting Director of the United States Patent and Trademark Office*